US011225934B2

(12) United States Patent
Steinman et al.

(10) Patent No.: US 11,225,934 B2
(45) Date of Patent: Jan. 18, 2022

(54) EVAPORATIVE EMISSIONS CONTROL SYSTEM LEAK CHECK MODULE INCLUDING FIRST AND SECOND SOLENOID VALVES

(71) Applicant: Stoneridge, Inc., Novi, MI (US)

(72) Inventors: Robert J. Steinman, Lexington, OH (US); Benjamin A. Harriger, Bellville, OH (US)

(73) Assignee: STONERIDGE, INC., Novi, MI (US)

( * ) Notice: Subject to any disclaimer, the term of this patent is extended or adjusted under 35 U.S.C. 154(b) by 0 days.

(21) Appl. No.: 16/427,803

(22) Filed: May 31, 2019

(65) Prior Publication Data

US 2019/0368447 A1 Dec. 5, 2019

Related U.S. Application Data

(60) Provisional application No. 62/678,978, filed on May 31, 2018.

(51) Int. Cl.
*F02M 1/00* (2006.01)
*F02M 25/08* (2006.01)
*F02D 41/22* (2006.01)

(52) U.S. Cl.
CPC .... *F02M 25/0818* (2013.01); *F02M 25/0827* (2013.01); *F02D 2041/225* (2013.01)

(58) Field of Classification Search
CPC .. B60K 2015/0321; B60K 2015/03256; B60K 2015/03328; B60K 2015/03514; B60K 15/035; B60K 15/3504; F02M 25/08; F02M 25/0818; F02M 25/0854; F02M 25/089; F02M 37/045; G01M 3/00; G01M 3/26; G01M 3/32; G01M 9/00
USPC ..... 123/516, 518–520
See application file for complete search history.

(56) References Cited

U.S. PATENT DOCUMENTS

| | | | | |
|---|---|---|---|---|
| 5,408,866 | A | 4/1995 | Kawamura et al. | |
| 5,474,050 | A | 12/1995 | Cook et al. | |
| 5,987,968 | A | 11/1999 | Cook et al. | |
| 6,044,314 | A | 3/2000 | Cook et al. | |
| 6,131,550 | A | 10/2000 | Fritz et al. | |
| 6,196,203 | B1 * | 3/2001 | Grieve | F02M 25/08 123/198 D |

(Continued)

FOREIGN PATENT DOCUMENTS

EP 3315756 5/2018

OTHER PUBLICATIONS

Communication and European Search Report dated Oct. 22, 2019 in corresponding European Patent Application No. 13177532.9.

(Continued)

*Primary Examiner* — John Kwon

(74) *Attorney, Agent, or Firm* — Grossman, Tucker, Perrault & Pfleger, PLLC

(57) ABSTRACT

A system and method for leak check module including first and second solenoid valves. A first solenoid valve is configured to be coupled between a fuel vapor canister and atmospheric air for controlling air flow in a first flow path between the fuel vapor canister and atmospheric air. A pump is configured to be coupled to atmospheric air. A second solenoid valve is configured to be coupled between the pump and the fuel vapor canister for controlling air flow in a second flow path between the fuel vapor canister and atmospheric air through the pump.

15 Claims, 8 Drawing Sheets

(56) References Cited

U.S. PATENT DOCUMENTS

| | | | | |
|---|---|---|---|---|
| 6,550,315 | B2 | 4/2003 | Streib | |
| 6,820,467 | B2 | 11/2004 | Streib | |
| 6,845,652 | B2 | 1/2005 | Stegmann et al. | |
| 6,889,667 | B2 | 5/2005 | Fritz et al. | |
| 7,004,013 | B2 | 2/2006 | Kobayashi et al. | |
| 9,291,128 | B2 | 3/2016 | Dudar | |
| 9,399,970 | B2 | 7/2016 | Peters et al. | |
| 9,458,801 | B2 | 10/2016 | Dudar et al. | |
| 9,464,600 | B2 | 10/2016 | Yasuzaka et al. | |
| 9,587,595 | B2 | 3/2017 | Woods et al. | |
| 9,638,145 | B2 | 5/2017 | Itoh et al. | |
| 9,797,346 | B2 | 10/2017 | Takakura | |
| 9,797,348 | B2 | 10/2017 | Dudar | |
| 9,822,737 | B2 | 11/2017 | Dudar et al. | |
| 2003/0074958 | A1 | 4/2003 | Nagasaki et al. | |
| 2005/0044938 | A1 | 3/2005 | Tsuruta et al. | |
| 2015/0114089 | A1* | 4/2015 | Dudar | F02M 25/0809 73/40 |
| 2015/0122229 | A1* | 5/2015 | Dudar | F02M 25/0818 123/518 |
| 2015/0337775 | A1* | 11/2015 | Dudar | F02M 25/08 123/520 |
| 2016/0040630 | A1* | 2/2016 | Li | F02M 25/0809 73/40.5 R |
| 2017/0328806 | A1 | 11/2017 | Kaneko et al. | |
| 2018/0066595 | A1 | 3/2018 | Dudar et al. | |

OTHER PUBLICATIONS

European Office Action dated Jun. 30, 2020 in corresponding European Patent Application Serial No. 19177532.9.
Communication Pursuant to Article 94(3) EPC dated Oct. 6, 2020 in corresponding European Patent Application No. 19177532.9.

* cited by examiner

EVAPORATIVE EMISSIONS CONTROL SYSTEM LEAK CHECK MODULE INCLUDING FIRST AND SECOND SOLENOID VALVES

CROSS REFERENCE TO RELATED APPLICATIONS

The present application claims the benefit of the filing date of U.S. Provisional Application Ser. No. 62/678,978, filed May 31, 2018, the entire teachings of which are hereby incorporated herein by reference.

FIELD

The present disclosure generally relates to Evaporative Emission Control Systems (EVAP) for automotive vehicles, and, more specifically, to an EVAP system leak check module including first and second solenoid valves.

BACKGROUND

Gasoline, the fuel for many automotive vehicles, is a volatile liquid subject to potentially rapid evaporation, in response to diurnal variations in the ambient temperature. Thus, the fuel contained in automobile gas tanks presents a major source of potential emission of hydrocarbons into the atmosphere. Such emissions from vehicles are termed 'evaporative emissions' and those vapors can emit vapors even when the engine is not running In response to this problem, industry has incorporated evaporative emission control (EVAP) systems into automobiles to prevent fuel vapor from being discharged into the atmosphere. Known EVAP systems generally include a canister, e.g. a carbon canister containing adsorbent carbon, that traps fuel vapor. Periodically, a purge cycle feeds the captured vapor to the intake manifold for combustion, thus reducing evaporative emissions.

Hybrid electric vehicles, including plug-in hybrid electric vehicles (HEV's or PHEV's), pose a particular problem for effectively controlling evaporative emissions. Although hybrid vehicles have been proposed and introduced in a number of forms, some hybrid vehicles use a combustion engine as backup to an electric motor. Primary power is provided by the electric motor, and careful attention to charging cycles can produce an operating profile in which the combustion engine is only run for short periods. Systems in which the combustion engine is only operated once or twice every few weeks are not uncommon. In known systems purging the carbon canister can only occur when the engine is running, and if the canister is not purged, the carbon pellets can become saturated, after which hydrocarbons will escape to the atmosphere, causing pollution.

To address this issue, EVAP systems are generally sealed to prevent the escape of any hydrocarbons. These systems require periodic leak detection tests to identify potential problems. Several different leak check systems have been developed. The systems may be generally classified as vacuum-based, pressure-based or combined vacuum and pressure-based techniques.

Vacuum-based techniques rely on evacuating the EVAP system and then monitoring to determine whether the system can hold the vacuum without bleed-up. Pressure-based techniques involve pressurizing the EVAP system and monitoring to determine whether the system can maintain the pressure. Combined techniques use a combination of vacuum and pressure-based techniques.

One known vacuum-based technique configuration uses a pump for generating a vacuum and a check valve to determine leakage. Drawbacks to this configuration include the potential that the check valve will seal or leak and the potential for system seals resulting from corking of the system solenoid canister vent valve at the completion of a leak test. Also, this known configuration is not readily adaptable to use in both pressure and vacuum based systems.

BRIEF DESCRIPTION OF THE DRAWINGS

Features and advantages of the claimed subject matter will be apparent from the following detailed description of embodiments consistent therewith, which description should be considered with reference to the accompanying drawings, wherein:

DETAILED DESCRIPTION

By way of an overview, a system or method consistent with the present disclosure is generally directed to an EVAP system leak check monitor including two solenoid valves and a pump system. One of the solenoid valves acts as a canister vent valve (CVV) to control air flow through the main EVAP system flow path for evaporative canister purge flow and re-fuel flow of air and fuel vapor. The second valve acts as a canister vent valve check (CVV check) valve for controlling air flow through a secondary path through the pump system. The pump system includes a pump that may apply a vacuum and/or pressure for checking EVAP system leakage.

Advantageously, a system consistent with the present disclosure may eliminate or substantially reduce the possibility of a leaking or sealing vacuum check valve and prevents the CVV from corking (sealing) after completion of vacuum testing. Also, the system may be used in vacuum and/or pressure-based leakage test systems. In addition, foam element filtration may be provided on the inlet and outlet sides of the pump to prevent contaminants from damaging the pump. Also, a system consistent with the present disclosure may be configured without an integrated pressure sensor to provide system flexibility and reduced cost and complexity.

Figure 1:
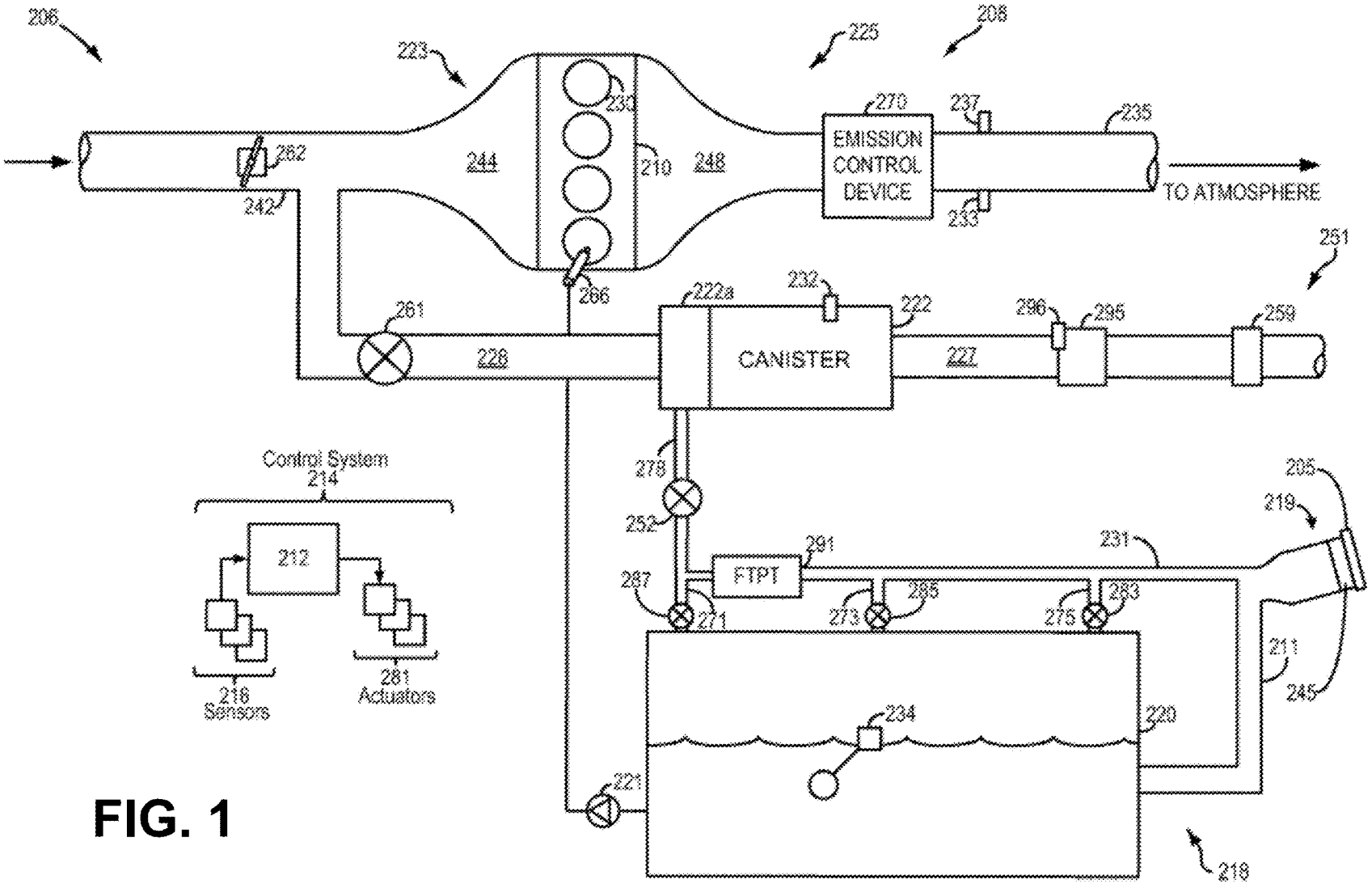
FIG. 1 diagrammatically illustrates an example vehicle system with a fuel system and an evaporative emissions system.

Before turning to details of a leak check monitor consistent with the present disclosure, operation of a vehicle system including a leak check monitor will be discussed. FIG. 1 shows a schematic depiction of a vehicle system 206. The vehicle system 206 includes an engine system 208 coupled to an EVAP system 251 and a fuel system 218. The EVAP system 251 includes a fuel vapor container or canister 222 which may be used to capture and store fuel vapors. In some examples, vehicle system 206 may be a hybrid electric vehicle system.

The engine system 208 may include an engine 210 having a plurality of cylinders 230. The engine 210 includes an engine intake 223 and an engine exhaust 225. The engine intake 223 includes a throttle 262 fluidly coupled to the engine intake manifold 244 via an intake passage 242. The engine exhaust 225 includes an exhaust manifold 248 leading to an exhaust passage 235 that routes exhaust gas to the atmosphere. The engine exhaust 225 may include one or more emission control devices 270, which may be mounted in a close-coupled position in the exhaust. One or more emission control devices may include a three-way catalyst, lean NOx trap, diesel particulate filter, oxidation catalyst, etc. It will be appreciated that other components may be included in the engine such as a variety of valves and sensors.

The fuel system 218 may include a fuel tank 220 coupled to a fuel pump system 221. The fuel pump system 221 may include one or more pumps for pressurizing fuel delivered to the injectors of engine 210, such as the example injector 266 shown. While only a single injector 266 is shown, additional injectors are provided for each cylinder. It will be appreciated that fuel system 218 may be a return-less fuel system, a return fuel system, or various other types of fuel system. The fuel tank 220 may hold a plurality of fuel blends, including fuel with a range of alcohol concentrations, such as various gasoline-ethanol blends, including E10, E85, gasoline, etc., and combinations thereof. A fuel level sensor 234 located in fuel tank 220 may provide an indication of the fuel level ("Fuel Level Input") to controller 212. As depicted, fuel level sensor 234 may comprise a float connected to a variable resistor. Alternatively, other types of fuel level sensors may be used.

Vapors generated in fuel system 218 may be routed to the EVAP system 251, which includes a fuel vapor canister 222, via vapor recovery line 231, before being purged to the engine intake 223. The vapor recovery line 231 may be coupled to fuel tank 220 via one or more conduits and may include one or more valves for isolating the fuel tank during certain conditions. For example, the vapor recovery line 231 may be coupled to fuel tank 220 via one or more or a combination of conduits 271, 273, and 275.

Further, in some examples, one or more fuel tank vent valves in conduits 271, 273, or 275. Among other functions, fuel tank vent valves may allow a fuel vapor canister of the EVAP system to be maintained at a low pressure or vacuum without increasing the fuel evaporation rate from the tank (which would otherwise occur if the fuel tank pressure were lowered). For example, the conduit 271 may include a grade vent valve (GVV) 287, the conduit 273 may include a fill limit venting valve (FLVV) 285, and the conduit 275 may include a grade vent valve (GVV) 283. Further, in some examples, the vapor recovery line 231 may be coupled to a fuel filler system 219. In some examples, the fuel filler system may include a fuel cap 205 for sealing off the fuel filler system from the atmosphere. The refueling system 219 is coupled to fuel tank 220 via a fuel filler pipe or neck 211.

Further, the refueling system 219 may include refueling lock 245. In some embodiments, the refueling lock 245 may be a fuel cap locking mechanism. The fuel cap locking mechanism may be configured to automatically lock the fuel cap in a closed position so that the fuel cap cannot be opened. For example, the fuel cap 205 may remain locked via refueling lock 245 while pressure or vacuum in the fuel tank is greater than a threshold. In response to a refuel request, e.g., a vehicle operator-initiated request, the fuel tank may be depressurized, and the fuel cap unlocked after the pressure or vacuum in the fuel tank falls below a threshold. A fuel cap locking mechanism may be a latch or clutch, which, when engaged, prevents the removal of the fuel cap. The latch or clutch may be electrically locked, for example, by a solenoid, or may be mechanically locked, for example, by a pressure diaphragm.

In some embodiments, the refueling lock 245 may be a filler pipe valve located at a mouth of fuel filler pipe 211. In such embodiments, the refueling lock 245 may not prevent the removal of fuel cap 205. Rather, the refueling lock 245 may prevent the insertion of a refueling pump into fuel filler pipe 211. The filler pipe valve may be electrically locked, for example by a solenoid, or mechanically locked, for example by a pressure diaphragm.

In some embodiments, the refueling lock 245 may be a refueling door lock, such as a latch or a clutch which locks a refueling door located in a body panel of the vehicle. The refueling door lock may be electrically locked, for example by a solenoid, or mechanically locked, for example by a pressure diaphragm.

In embodiments where the refueling lock 245 is locked using an electrical mechanism, the refueling lock 245 may be unlocked by commands from controller 212, for example, when a fuel tank pressure decreases below a pressure threshold. In embodiments where refueling lock 245 is locked using a mechanical mechanism, the refueling lock 245 may be unlocked via a pressure gradient, for example, when a fuel tank pressure decreases to atmospheric pressure.

The EVAP system 251 may include one or more emissions control devices, such as one or more fuel vapor canisters 222 filled with an appropriate adsorbent. The canisters 222 are configured to temporarily trap fuel vapors (including vaporized hydrocarbons) during fuel tank refilling operations and "running loss" (that is, fuel vaporized during vehicle operation). In one example, the adsorbent used is activated charcoal. The EVAP system 251 may further include a canister ventilation path or vent line 227 which may route gases out of the canister 222 to the atmosphere when storing, or trapping, fuel vapors from fuel system 218.

The canister 222 may include a buffer 222*a* (or buffer region), each of the canister and the buffer comprising the adsorbent. As shown, the volume of buffer 222*a* may be smaller than (e.g., a fraction of) the volume of canister 222. The adsorbent in the buffer 222*a* may be the same as, or different from, the adsorbent in the canister (e.g., both may include charcoal). The buffer 222*a* may be positioned within canister 222 such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine. One or more temperature sensors 232 may be coupled to and/or within canister 222. As fuel vapor is adsorbed by the adsorbent in the canister, heat is generated (heat of adsorption). Likewise, as fuel vapor is desorbed by the adsorbent in the canister, heat is consumed. In this way, the adsorption and desorption of fuel vapor by the canister may be monitored and estimated based on temperature changes within the canister.

The vent line 227 may also allow fresh air to be drawn into canister 222 when purging stored fuel vapors from fuel system 218 to engine intake 223 via purge line 228 and purge valve 261. For example, the purge valve 261 may be normally closed but may be opened during certain conditions so that vacuum from engine intake manifold 244 is provided to the fuel vapor canister for purging. In some examples, the vent line 227 may include an air filter 259 disposed therein upstream of a canister 222.

The flow of air and vapors between canister 222 and the atmosphere may be regulated by a canister vent valve coupled within vent line 227, e.g. within the LCM 295 as will be discussed in further detail below. The canister vent valve may be a normally open valve, so that fuel tank isolation valve 252 (FTIV) may control venting of fuel tank 220 with the atmosphere. FTIV 252 may be positioned between the fuel tank and the fuel vapor canister within conduit 278. FTIV 252 may be a normally closed valve, that when opened, allows for the venting of fuel vapors from fuel tank 220 to canister 222. Fuel vapors may then be vented to atmosphere or purged to engine intake system 223 via canister purge valve 261.

The fuel system 218 may be operated by controller 212 in a plurality of modes by selective adjustment of the various valves and solenoids. For example, the fuel system may be operated in a fuel vapor storage mode (e.g., during a fuel tank refueling operation and with the engine not running), wherein the controller 212 may open isolation valve 252 while closing canister purge valve (CPV) 261 to direct refueling vapors into canister 222 while preventing fuel vapors from being directed into the intake manifold.

As another example, the fuel system may be operated in a refueling mode (e.g., when fuel tank refueling is requested by a vehicle operator), wherein the controller 212 may open isolation valve 252, while maintaining canister purge valve 261 closed, to depressurize the fuel tank before allowing fuel to be added therein. As such, isolation valve 252 may be kept open during the refueling operation to allow refueling vapors to be stored in the canister. After refueling is completed, the isolation valve may be closed.

As yet another example, the fuel system may be operated in a canister purging mode (e.g., after an emission control device light-off temperature has been attained and with the engine running), wherein the controller 212 may open canister purge valve 261 while closing isolation valve 252. Herein, the vacuum generated by the intake manifold of the operating engine may be used to draw fresh air through vent 227 and through fuel vapor canister 222 to purge the stored fuel vapors into intake manifold 244. In this mode, the purged fuel vapors from the canister are combusted in the engine. The purging may be continued until the stored fuel vapor amount in the canister is below a threshold.

The controller 212 may comprise a portion of a control system 214. The control system 214 is shown receiving information from a plurality of sensors 216 (various examples of which are described herein) and sending control signals to a plurality of actuators 281 (various examples of which are described herein). For example, the sensors 216 may include exhaust gas sensor 237 located upstream of the emission control device, temperature sensor 233, pressure sensor 291, and canister temperature sensor 243. Other sensors such as pressure, temperature, air/fuel ratio, and composition sensors may be coupled to various locations in the vehicle system 206. For example, the actuators may include a fuel injector 266, a throttle 262, a fuel tank isolation valve 252, a pump 221, and a refueling lock 245. The control system 214 may include a controller 212. The controller may receive input data from the various sensors, process the input data, and trigger the actuators in response to the processed input data based on instruction or code programmed therein corresponding to one or more routines.

Leak detection routines may be intermittently performed by controller 212 on fuel system 218 to confirm that the fuel system is not degraded. As such, leak detection routines may be performed while the engine is off (engine-off leak test) using engine-off natural vacuum (EONV) generated due to a change in temperature and pressure at the fuel tank following engine shutdown and/or with vacuum supplemented from a vacuum pump. Alternatively, leak detection routines may be performed while the engine is running by operating a vacuum pump and/or using engine intake manifold vacuum. Leak tests may be performed using a leak check module (LCM) 295 coupled in the vent 227, between canister 222 and the atmosphere.

To diagnose a leak in the system, the leak test routine performed by the controller 212 causes the LCM 295 to apply a positive or negative (vacuum) pressure in the fuel system and monitors the change in the pressure over a period of time. Any change in pressure greater than a predetermined threshold indicates a leak in the system. The pressure may be sensed by any pressure sensor in the system and positioned in any portion of the system wherein the positive or negative pressure is generated by the LCM 295. In some embodiments, an optional reference orifice and optional pressure sensor 296 may be provided in a flow path within the LCM 295 or coupled to the LCM 295 so that when a pressure or vacuum is applied by the pump a reference pressure is drawn across the reference orifice and sensed by the pressure sensor to indicate a reference pressure in the system. The pressure sensor 296 may be coupled to the controller 212. Following application of pressure to the fuel system, a change in pressure at the reference orifice (e.g., an absolute change or a rate of change) may be monitored using the pressure sensor 296 and compared to a threshold by the controller 212. Based on the comparison, a fuel system leak may be diagnosed.

Figure 2:
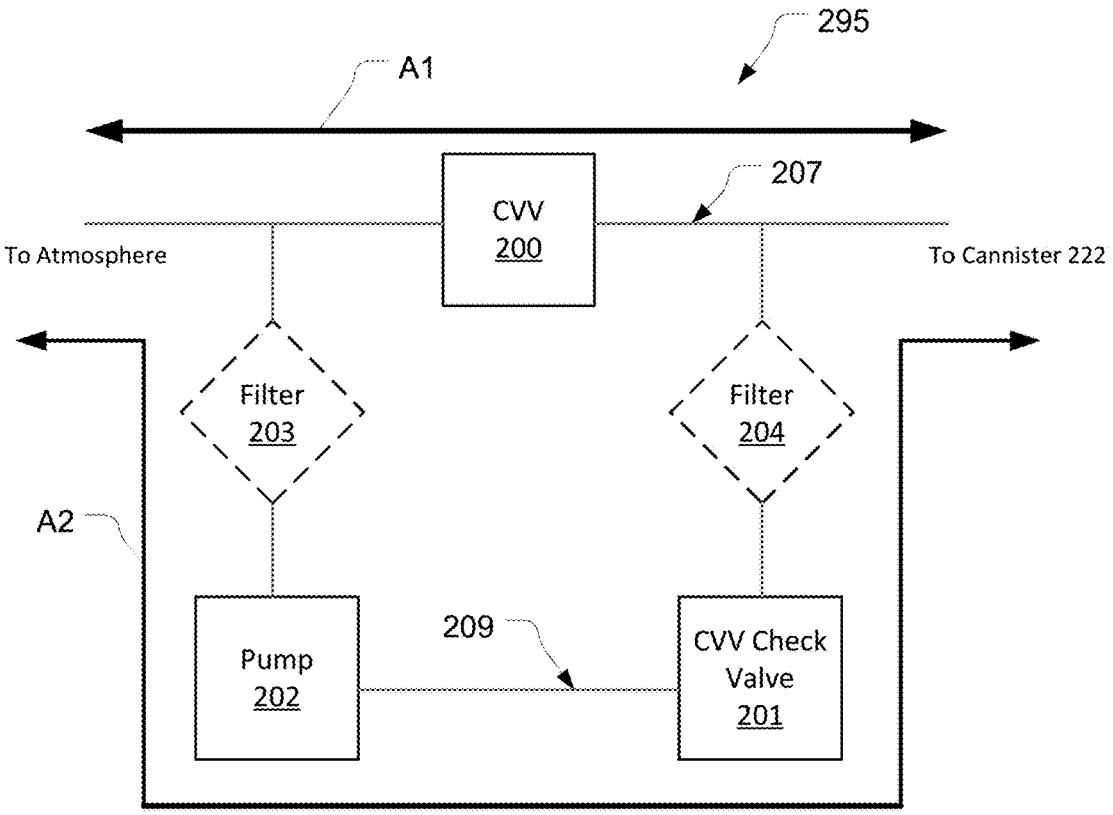
FIG. 2 diagrammatically illustrates an example of a leak check module consistent with the present disclosure.

Turning now to FIG. 2, there is illustrated one example of an LCM 295 consistent with the present disclosure. In the illustrated embodiment, the LCM 295 includes a canister vent valve (CVV) 200, a canister vent valve check (CVV check) valve 201, a pump 202 and optional foam element filters 203, 204 at the inlet and outlet of the pump 202. The CVV 200 has a first port coupled to atmospheric air, e.g. through the filter 259 (FIG. 1) and a second port coupled to the canister 222. The CVV 200 thus controls air flow in a purge/refuel flow path 207 (also referred to herein as a first flow path) in the directions indicated by arrow A1 between the canister 222 and atmospheric air. The pump 202 has a first port coupled to the atmospheric and a second port coupled to a first port of CVV check valve 201. A second port of the CVV check valve 201 is coupled to the canister 202, e.g. through the optional filter 204. The CVV check valve 201 thus controls air flow in a test flow path 209 (also referred to herein as a second flow path) in the directions indicated by arrow A2 between the fuel vapor canister 222 and atmospheric air through the pump 202. The test flow path 209 includes the CVV check valve 201, the pump 202 and, optionally, the filters 203, 204 and bypasses the CVV 200.

The pump 202 may be configured to provide positive and/or negative (vacuum) pressure to the fuel system when a leak test is administered. In some embodiments, for example, the pump 202 may be a reversible vane pump. The pump 202 may be turned on or off by control signals from the controller 212 when the controller 212 is performing purge, refuel and/or leak test routines. The optional filters 203, 204 may be known filter elements for blocking dust and other contaminants from reaching the pump 202 and CVV check valve 201. The CVV 200 and CVV check valve 201 are solenoid valves that are independently movable, e.g. under the control of the controller 212, between open and closed positions when the controller 212 is performing a purge, refuel and/or leak test routine. In the illustrated embodiment, the CVV 200 and CVV check valve 201 may be closed to block an airflow path therethrough by energizing the CVV 200 and CVV check valve 201 using signals from the controller 212. The CVV 200 and CVV check valve 201 may be opened to allow air flow therethrough by deenergizing the CVV 200 and CVV check valve 201, e.g. by removing the signals from the controller 212.

The illustrated example embodiment does not include a pressure sensor or reference orifice. In some embodiments, a pressure sensor and/or reference orifice may be positioned outside of the LCM 295 in any portion of the system wherein the positive or negative pressure is generated by the LCM 295. Omitting a pressure sensor from the LCM 295 provides flexibility in system design and reduce cost and complexity of the LCM. In other embodiments, for example, a pressure sensor and/or reference orifice may be provided in a reference flow path coupled in parallel to the test flow path 209.

Figure 3A:
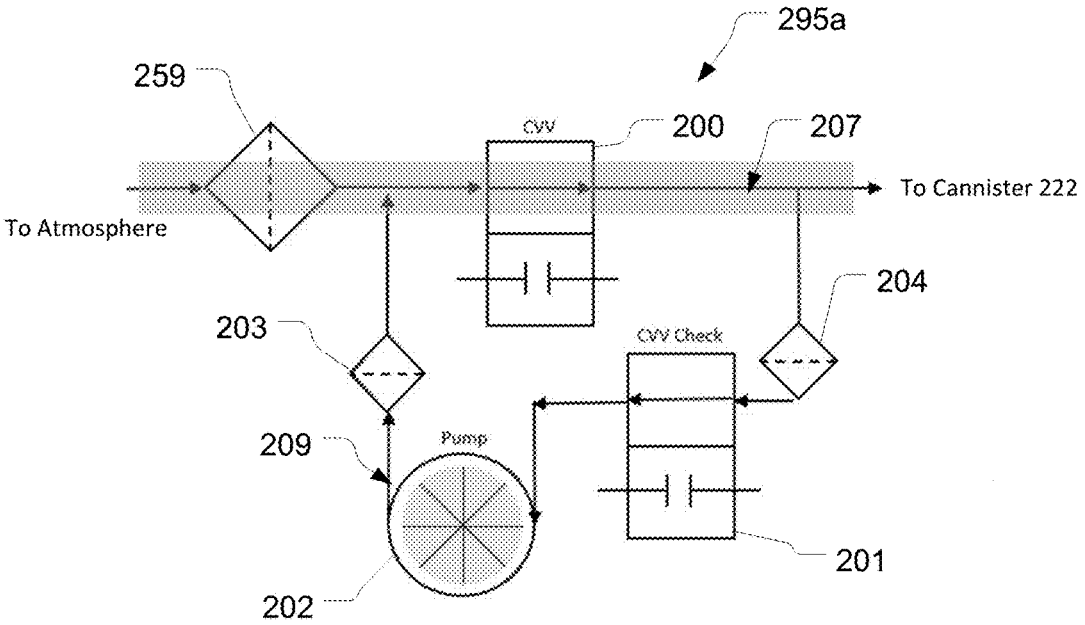
FIG. 3A diagrammatically illustrates an example leak check module consistent with the present disclosure in a configuration to perform a purging operation when the pump is in a vacuum mode.
Figure 3B:
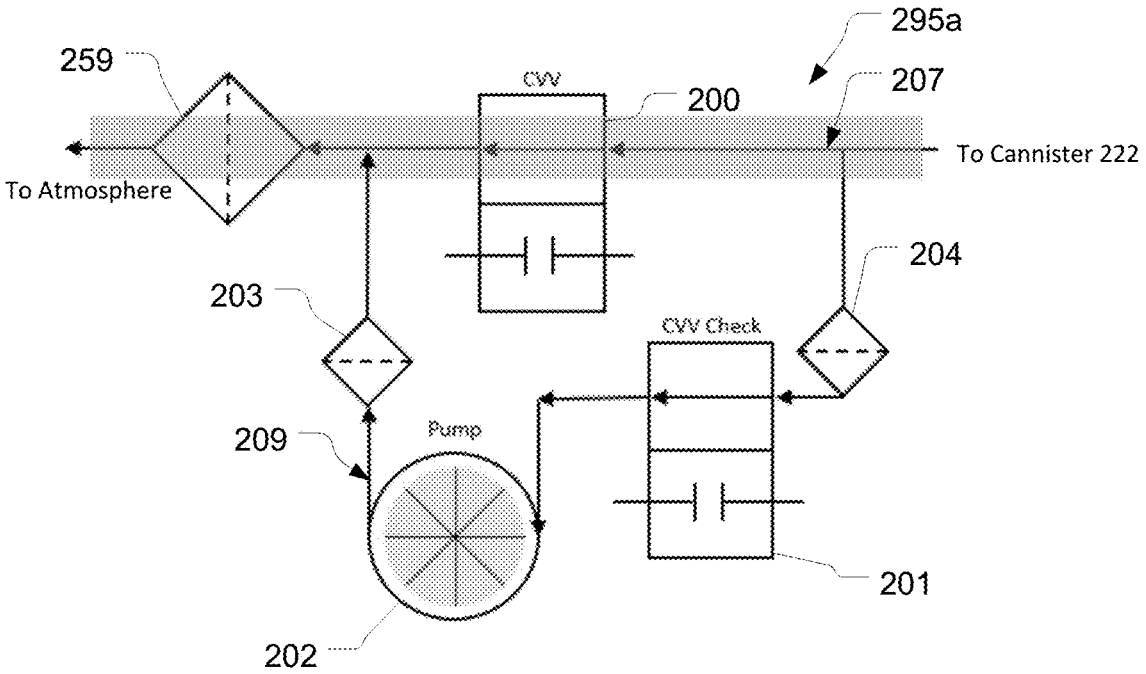
FIG. 3B diagrammatically illustrates an example leak check module consistent with the present disclosure in a configuration to perform a refueling operation when the pump is in a vacuum mode.
Figure 3C:
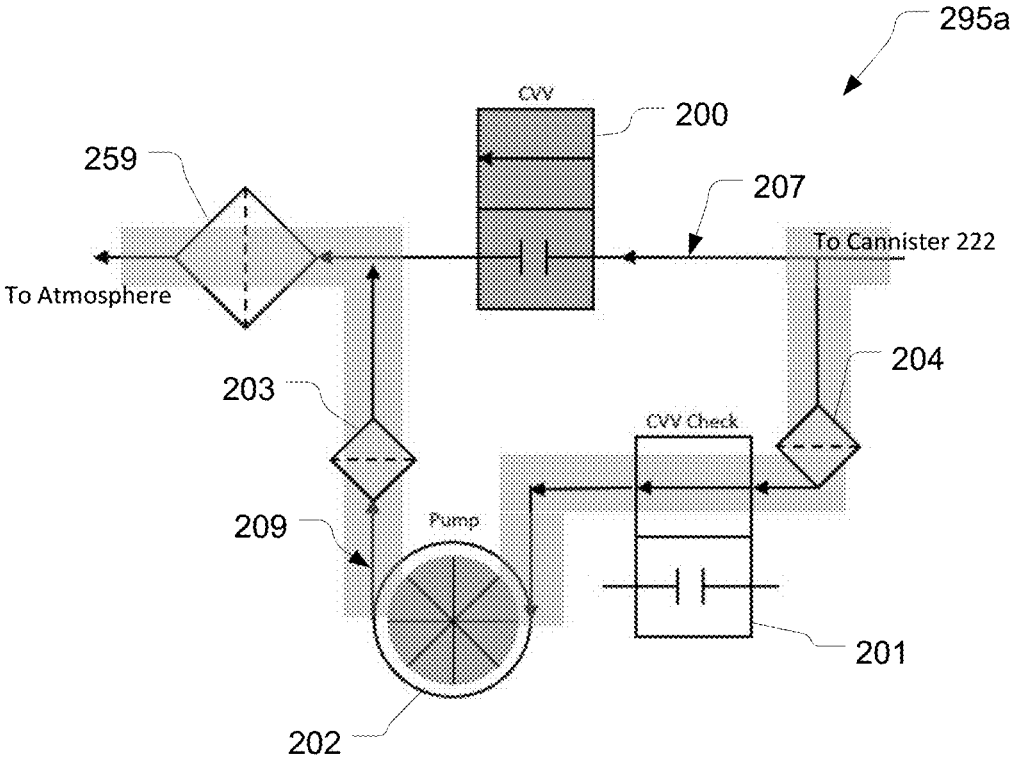
FIG. 3C diagrammatically illustrates an example leak check module consistent with the present disclosure in a configuration to leak check when the pump is in a vacuum mode.

Operation of one example embodiment of an LCM 295*a* will now be described in connection with FIGS. 3A-3C. In the illustrated embodiment the LCM 295*a* includes the CVV 200, CVV check valve 201, the pump 202 and the filters 203, 204. The pump 202 in the embodiment illustrated in FIGS. 3A-3C is configured to operate in a vacuum (negative pressure) mode. FIG. 3A illustrates operation of the LCM 295*a* when the fuel system is operating in a purging mode. FIG. 3B illustrates operation of the LCM 295*a* when the fuel system is operating in a refueling mode. FIG. 3C illustrates operation of the LCM 295*a* when the fuel system is operating in a leak test mode. In FIGS. 3A-3C, the arrows in the purge/refuel 207 and test 209 paths indicate the direction of airflow in the depicted mode of operation.

With reference to FIG. 3A, when the controller 212 is operating the fuel system in a purging mode, the CVV 200 and CVV check valve 201 are both open and the pump 202 is off. Accordingly, atmospheric air flows through the purge/refuel path 207 including the CVV 200 in the direction from the atmosphere to the canister 222 for purging the canister 222. In some embodiments, for example, the flow rate through the purge/refuel path 207 and the CVV 200 may be approximately 60 liters per minute (lpm). Since the pump 202 is off, only minimal air flows through the test path 209 including the CVV check valve 201.

With reference to FIG. 3B, when the controller 212 is operating the system in a refueling mode, the CVV 200 and CVV check valve 201 are both open and the pump 202 is off. Accordingly, air flows in the direction from the canister 222 to the atmosphere through the purge/refuel path 207 including the CVV 200 for refueling. In some embodiments, for example, the flow rate through the purge/refuel path 207 and the CVV 200 may be approximately 60 liters per minute (lpm). Since the pump 202 is off, only minimal air flows through the test path 209 including the CVV check valve 201.

With reference to FIG. 3C, when the controller 212 executes a leak check routine, the CVV 200 is closed, the CVV check valve 201 is open and the pump 202 is on. Accordingly, air flows through the test path 209 in the direction from the canister 222 to the atmosphere to generate a vacuum in the fuel system. In some embodiments, for example, the pump 202 may generate an air flow of about 3-5 lpm through the test path 209 including the CVV check valve 201 and about 3 kilopascals (kPa) of pressure may be applied to the CVV 200. In some embodiments, for example, it may take about 3 minutes for the pump 202 to generate a vacuum in the fuel system sufficient for performing the leak test.

Once the pump 202 generates a vacuum in the fuel system sufficient for performing the leak test, the pump 202 is switched off and the CVV check valve 201 is closed. The CVV 200 remains closed after the required vacuum is generated. The leak test routine may then monitor pressure changes in the system to determine if there is a leak.

When the leak test is complete, the pump 202 is turned off and the CVV 200 and CVV check valve are opened, i.e. deenergized in the illustrated example embodiment. When the CVV 200 and CVV check valve 201 are deenergized corking or sealing of the system may be prevented by having atmospheric pressure and fuel system pressure across the CVV 200 and the CVV check valve 201. In some embodiments, for example the fuel system pressure may be about 3 kPa when the CVV 200 and CVV check valve 201 are deenergized.

Figure 4A:
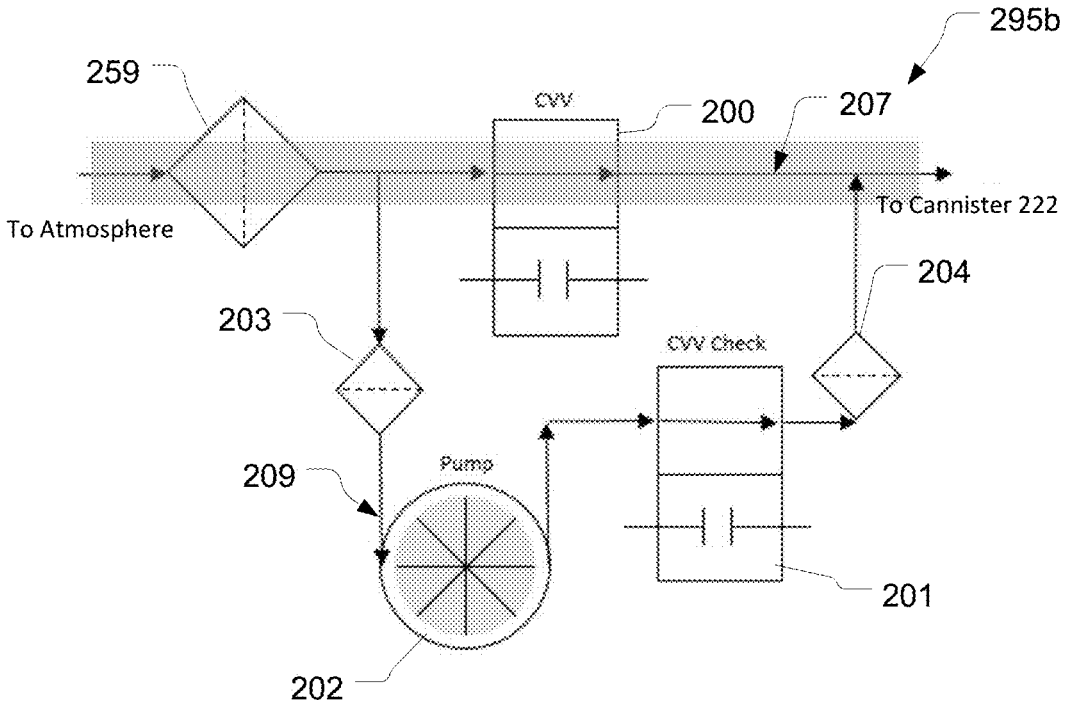
FIG. 4A diagrammatically illustrates an example leak check module consistent with the present disclosure in a configuration to perform a purging operation when the pump is in a pressure mode.
Figure 4B:
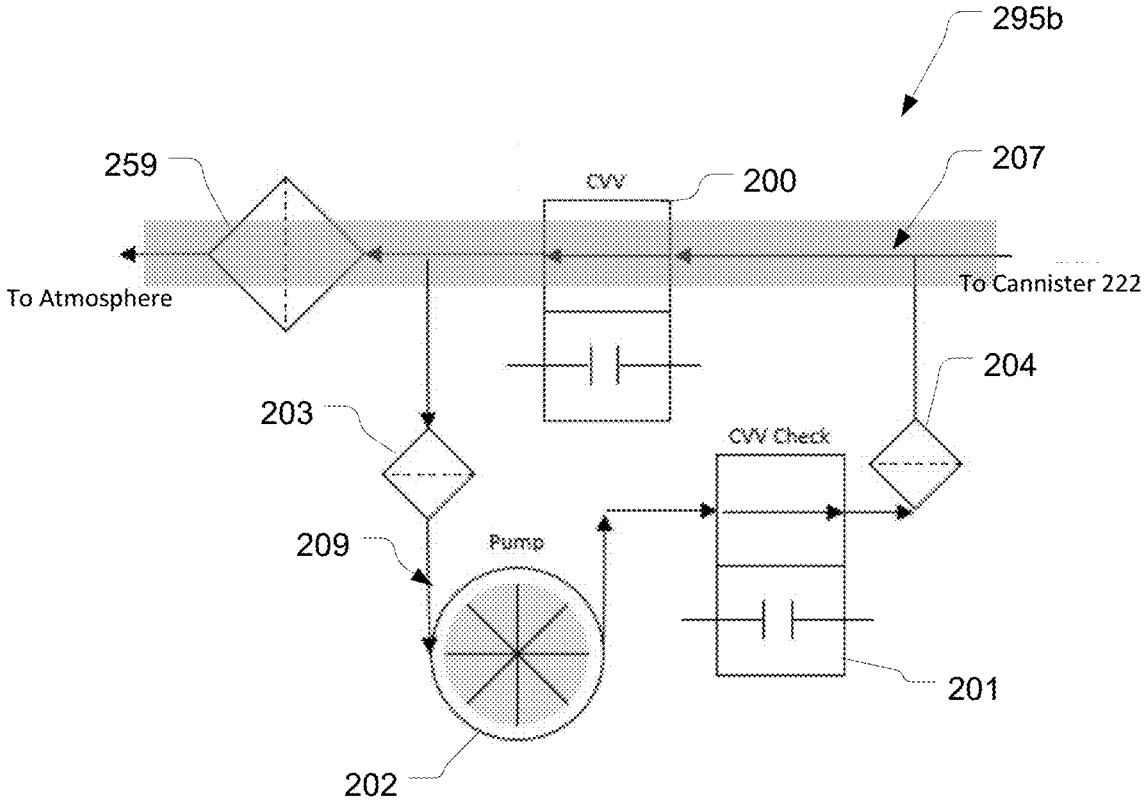
FIG. 4B diagrammatically illustrates an example leak check module consistent with the present disclosure in a configuration to perform a refueling operation when the pump is in a pressure mode.
Figure 4C:
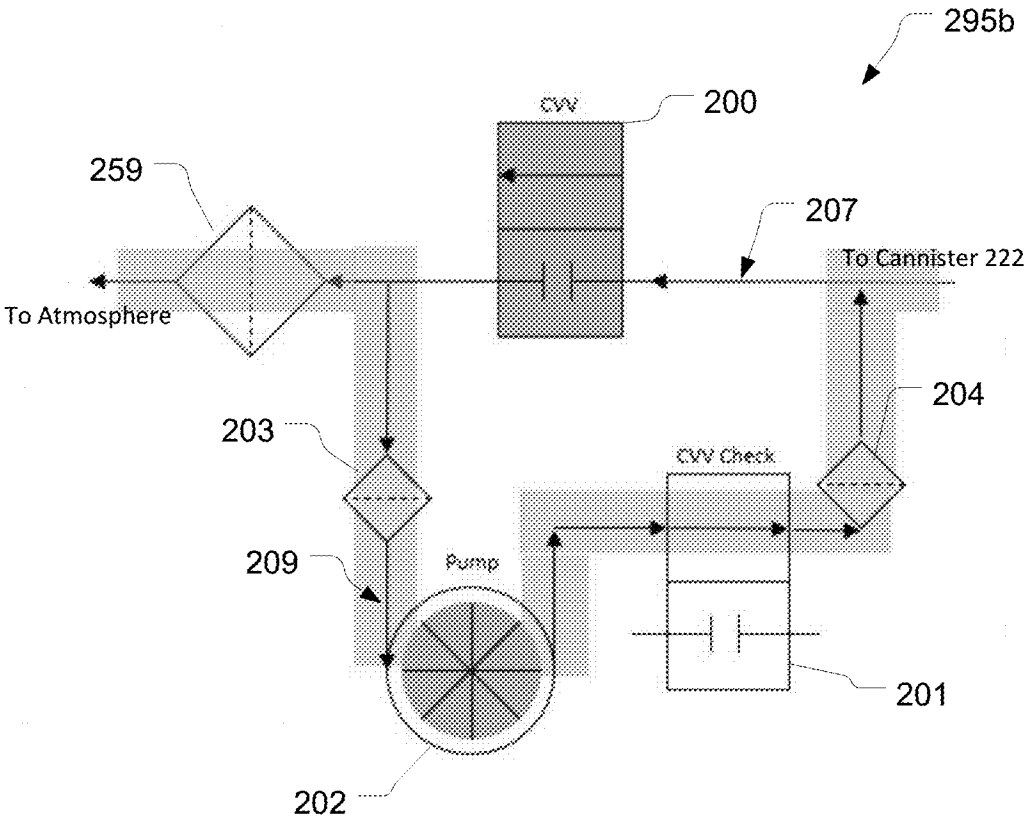
FIG. 4C diagrammatically illustrates an example leak check module consistent with the present disclosure in a configuration to leak check when the pump is in a pressure mode.

Operation of another example embodiment of an LCM 295*b* will now be described in connection with FIGS. 4A-4C. The illustrated embodiment is similar to the LCM 295*a*, except that the pump 202 in the embodiment illustrated in FIGS. 4A-4C is configured to operate in a positive pressure mode, instead of negative pressure, vacuum mode. FIG. 4A illustrates operation of the LCM 295*b* when the fuel system is operating in a purging mode. FIG. 4B illustrates operation of the LCM 295*b* when the fuel system is operating in a refueling mode. FIG. 4C illustrates operation of the LCM 295*b* when the fuel system is operating in a leak test mode. In FIGS. 4A-4C, the arrows in the purge/refuel 207 and test 209 paths indicate the direction of airflow in the depicted mode of operation.

With reference to FIG. 4A, when the controller 212 is operating the fuel system in a purging mode, the CVV 200 and CVV check valve 201 are both open and the pump 202 is off. Accordingly, atmospheric air flows through the purge/refuel path 207 including the CVV 200 in the direction from the atmosphere to the canister 222 for purging the canister 222. In some embodiments, for example, the flow rate through the purge/refuel path 207 and the CVV 200 may be approximately 60 liters per minute (lpm). Since the pump 202 is off, only minimal air flows through the test path 209 including the CVV check valve 201.

With reference to FIG. 4B, when the controller 212 is operating the system in a refueling mode, the CVV 200 and CVV check valve 201 are both open and the pump 202 is off. Accordingly, air flows in the direction from the canister 222 to the atmosphere through the purge/refuel path 207 including the CVV 200 for refueling. In some embodiments, for example, the flow rate through the purge/refuel path 207 and the CVV 200 may be approximately 60 liters per minute (lpm). Since the pump 202 is off, only minimal air flows through the test path 209 including the CVV check valve 201.

With reference to FIG. 4C, when the controller 212 executes a leak check routine, the CVV 200 is closed, the CVV check valve 201 is open and the pump 202 is on. Accordingly, air flows through the test path 209 in the direction from the atmosphere to the canister 222 to generate positive pressure in the fuel system. In some embodiments, for example, the pump 202 may generate an air flow of about 3-5 lpm through the test path 209 including the CVV check valve 201 and about 3 kilopascals (kPa) of pressure may be applied to the CVV 200. In some embodiments, for example, it may take about 3 minutes for the pump 202 to generate a positive pressure in the fuel system sufficient for performing the leak test.

Once the pump 202 generates a positive pressure in the fuel system sufficient for performing the leak test, the pump 202 is switched off and the CVV check valve 201 is closed. The CVV 200 remains closed after the required positive pressure is generated. The leak test routine may then monitor pressure changes in the system to determine if there is a leak.

When the leak test is complete, the pump 202 is turned off and the CVV 200 and CVV check valve are opened, i.e. deenergized in the illustrated example embodiment. When the CVV 200 and CVV check valve 201 are deenergized corking or sealing of the system may be prevented by having atmospheric pressure and fuel system pressure across the CVV 200 and the CVV check valve 201. In some embodiments, for example the fuel system pressure may be about 3 kPa when the CVV 200 and CVV check valve 201 are deenergized.

Figure 5:
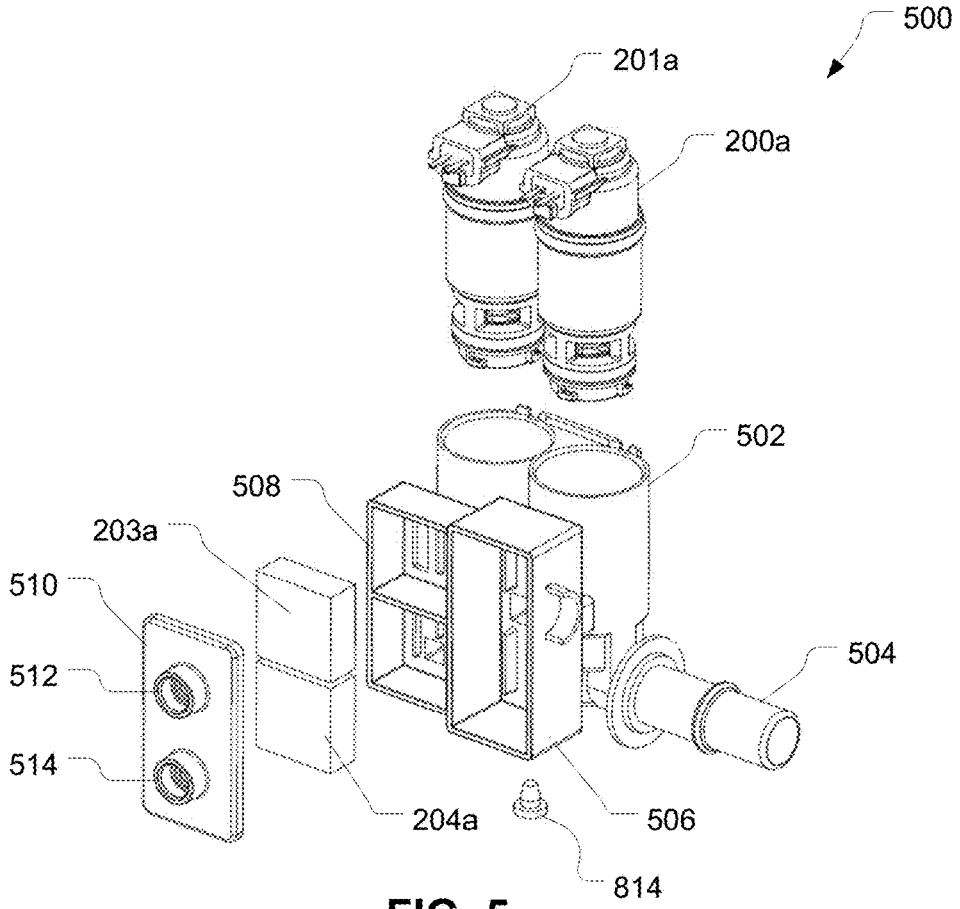
FIG. 5 is an exploded perspective view of one example of a valve and filter assembly portion of an example leak check module consistent with the present disclosure
Figure 6:
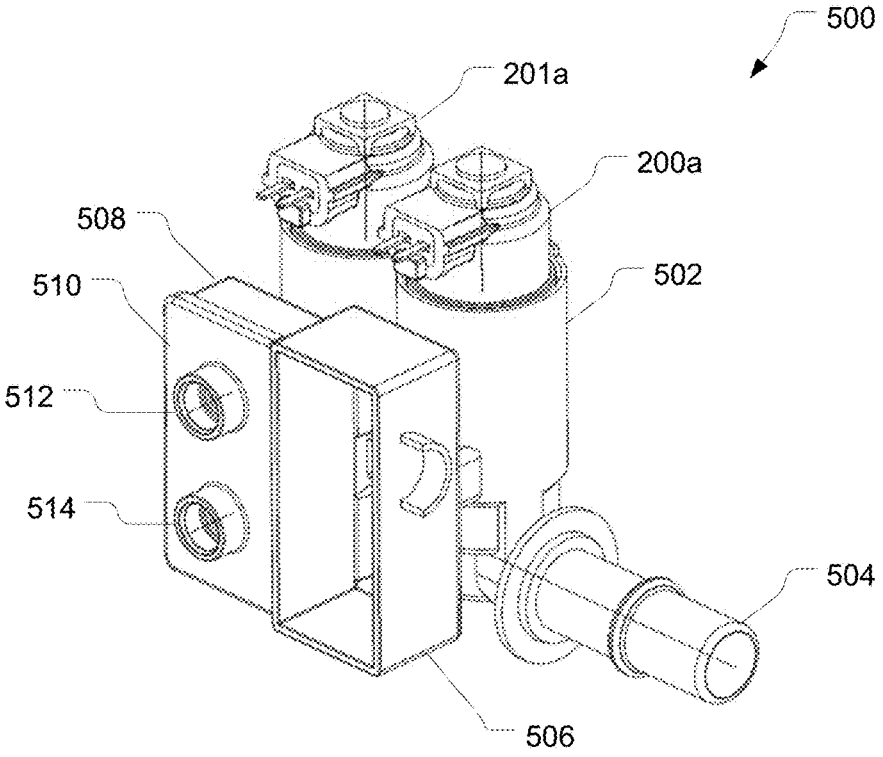
FIG. 6 is an assembly perspective view of one example of a valve and filter assembly portion of an example leak check module consistent with the present disclosure.

An LCM consistent with the present disclosure may be assembled in a variety of ways to provide flexibility in system design and reduce cost and complexity. FIG. 5, for example, is an exploded perspective view of a valve and filter assembly portion 500 of an LCM consistent with the present disclosure. FIG. 6 is a perspective assembly view of the valve and filter assembly portion 500 shown in FIG. 5.

The illustrated embodiment 500 includes a CVV 200*a* and a CVV check valve 201*a* disposed in a manifold 502. In general, the manifold 502 includes portions defining the flow paths 207, 209 through the LCM 295 illustrated in FIG. 2. In some embodiments, the manifold 502 may be a single-piece construction molded from a plastic material. A canister port 504 may be coupled to the manifold 502 for coupling the manifold 502 to the canister 222, e.g. using a tube or hose. ATM port 506 may be coupled to the manifold 502 for coupling the manifold 502 to the atmospheric air. The ATM port 506 may be coupled to the atmospheric air with, or without, a conduit, e.g. a tube or hose, coupled to the ATM port 506.

A pump port 508 may be coupled to the manifold 502 for coupling the pump 202 to the manifold 502. The pump port 508 may be configured to receive filters 203*a* and 204*a*. A filter cover 510 is configured to be coupled to the pump port 508 with the filters 203*a*, 204*a* disposed therebetween. The filter cover 510 includes a pump outlet port 512, i.e. the pump outlet for generating a positive pressure, for coupling the pump outlet to the CVV check valve 201*a* through the manifold 502, and pump inlet port 514 for coupling to the pump inlet to atmospheric air through the manifold 502 for generating a negative pressure (vacuum).

Figure 7:
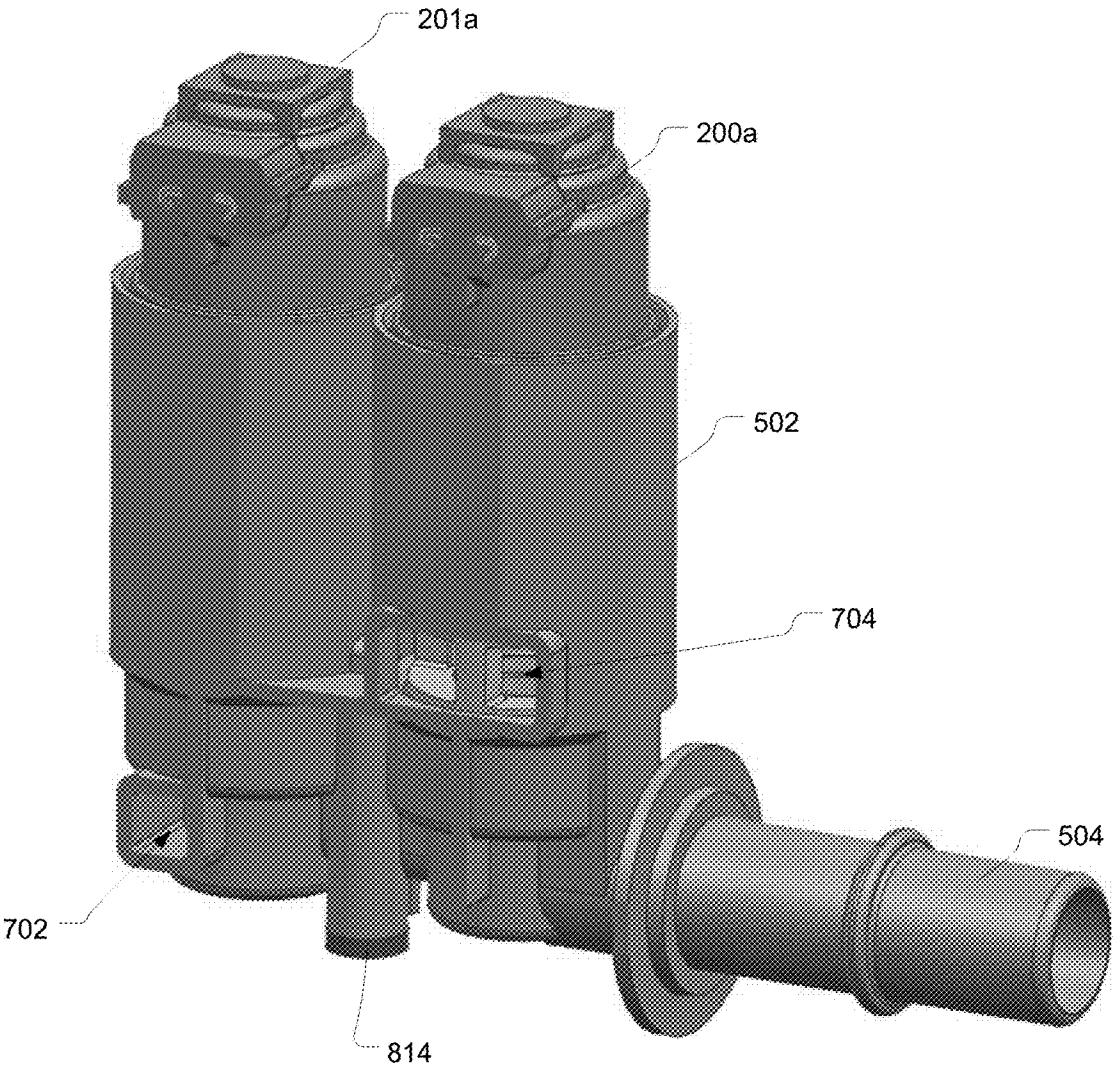
FIG. 7 is a perspective view of one example of a manifold consistent with the present disclosure including CVV solenoid and CVV check valve solenoids disposed therein.
Figure 8:
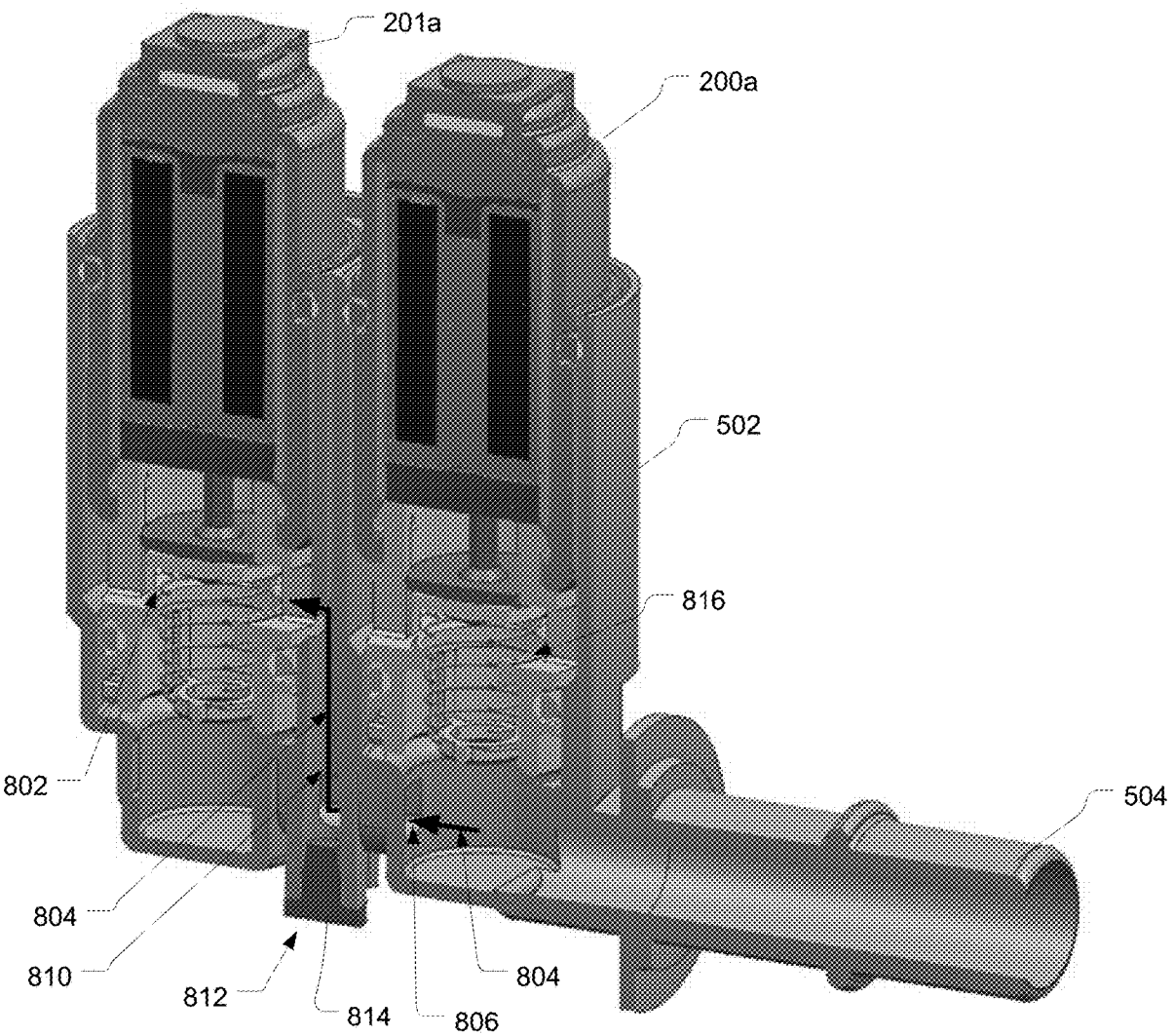
FIG. 8 is a perspective sectional view of one example of a manifold consistent with the present disclosure including CVV solenoid and CVV check valve solenoids disposed therein.

FIG. 7 is a perspective view of the manifold 502 with the CVV 200*a* and CVV check valve 201*a* mounted therein. FIG. 8 is a perspective sectional view of the manifold 502. As shown, the manifold 502 includes a pump inlet opening 702 disposed generally beneath the valve seat 802 of CVV check valve 201*a*. The pump inlet opening 702 may be coupled to the pump inlet port 514 through the pump port 508. A flow path 804 from the canister port 504 to the pump inlet port 508 may be defined by a passage 806 extending through a plenum wall 808 beneath the CVV 200*a* and through a central opening 810 in the manifold 502 between the CVV 200*a* and CVV check valve 201*a*. Closing the CVV check valve 201*a* closes the flow path 804 to the pump inlet port 508. The flow path 804 has service port 812 at a bottom thereof that is normally closed by a plug 814 during operation. The plug 814 may be removed to clean or otherwise service the manifold 502. The manifold 502 also includes and a purge/refuel opening 704 disposed above the valve seat 816 of the CVV 200*a*. Opening the CVV 200*a* connects the purge/refuel path from the canister port 504 to the atmosphere through the ATM port 506 and closing the CVV 200*a* seals the purge/refuel path.

According to one aspect of the present disclosure there is provided a leak check module for a fuel system including a canister vent valve (CVV) solenoid configured to be coupled between a fuel vapor canister and atmospheric air for controlling air flow in a first flow path between the fuel vapor canister and atmospheric air; a pump having a first port configured to be coupled to atmospheric air; and a CVV check valve solenoid configured to be coupled between a second port of the pump and the fuel vapor canister for controlling air flow in a second flow path between the fuel vapor canister and atmospheric air through the pump.

According to another aspect of the disclosure there is provided a method of performing a leak check in a vehicle fuel system. The method includes: coupling a fuel vapor canister of the vehicle to atmospheric air through a first flow path including a canister vent valve (CVV) solenoid; coupling the fuel vapor canister to the atmospheric air through a second flow path including a CVV check valve solenoid and a pump; closing the CVV solenoid to block air flow through the first flow path; opening the CVV check valve solenoid to allow air flow through the second flow path; and operating the pump to generate pressure in the fuel system. The method may further include turning the pump off when a test pressure is reached in the fuel system; closing the CVV check valve solenoid to block air flow through the second flow path; and monitoring the fuel system for pressure changes indicative of the leak. The method may further include: opening the CVV solenoid and the CVV check valve solenoid after the monitoring the fuel system for pressure changes indicative of the leak.

According to another aspect of the present disclosure there is provided a canister vent valve (CVV) solenoid coupled between a fuel vapor canister and atmospheric air for controlling air flow in a first flow path between the fuel vapor canister and atmospheric air; a pump having a first port coupled to atmospheric air; and a CVV check valve solenoid coupled between a second port of the pump and the fuel vapor canister for controlling air flow in a second flow path between the fuel vapor canister and atmospheric air through the pump While several embodiments of the present disclosure have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed.

The present disclosure is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one."

The term "coupled" as used herein refers to any connection, coupling, link or the like by which signals carried by one system element are imparted to the "coupled" element. Such "coupled" devices, or signals and devices, are not necessarily directly connected to one another and may be separated by intermediate components or devices that may manipulate or modify such signals. Likewise, the terms "connected" or "coupled" as used herein in regard to mechanical or physical connections or couplings is a relative term and does not require a direct physical connection.

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary. The terms "first," "second," and the like herein do not denote any order, quantity, or importance, but rather are used to distinguish one element from another, and the terms "a" and "an" herein do not denote a limitation of quantity, but rather denote the presence of at least one of the referenced items.

What is claimed is:

1. A leak check module for a fuel system comprising:

a single canister vent valve (CVV) solenoid configured to be coupled between a fuel vapor canister and atmospheric air for controlling air flow in a first flow path between the fuel vapor canister and atmospheric air;

a pump having a first port configured to be coupled to atmospheric air;

a single CVV check valve solenoid configured to be coupled between a second port of the pump and the fuel vapor canister for controlling air flow in a second flow path between the fuel vapor canister and atmospheric air through the pump; and a manifold, wherein the single CVV solenoid and the single CVV check valve solenoid are disposed in the manifold;

wherein all fluid flowing between the second port of the pump and the fuel vapor canister flows through the second flow path and the single CVV check valve solenoid; and wherein the leak check module does not include a reference orifice, and whereby a pressure sensor located outside of the leak check module is used to perform a leak check in the fuel system.

2. The leak check module of claim 1 wherein the pump is reversible for establishing a vacuum or a pressure in the fuel system such that the leak check module is configured to operate in both a negative pressure mode and a positive pressure mode.

3. The leak check module of claim 1 further comprising first and second filters coupled to the first and second ports of the pump, respectively.

4. The leak check module of claim 1 further comprising single-piece manifold.

5. The leak check module of claim 4, wherein the manifold includes a canister port configured for coupling to the fuel vapor canister and wherein the leak check module further comprises a pump port coupled to the manifold and configured for coupling to the pump and an atmosphere (ATM) port coupled to the manifold and configured for coupling to the atmospheric air.

6. The leak check module of claim 4 further comprising a flow path extending through a plenum wall beneath the CVV solenoid and through a central opening in the manifold between the CVV solenoid and CVV check valve solenoid.

7. The leak check module of claim 4, wherein the manifold includes a canister port configured for coupling to the fuel vapor canister, a pump inlet opening for coupling to the second port of the pump and a purge/refuel opening configured to be coupled to atmospheric air.

8. A vehicle fuel system comprising:

a single canister vent valve (CVV) solenoid coupled between a fuel vapor canister and atmospheric air for controlling air flow in a first flow path between the fuel vapor canister and atmospheric air;

a pump having a first port coupled to atmospheric air;

a single CVV check valve solenoid coupled between a second port of the pump and the fuel vapor canister for controlling air flow in a second flow path between the fuel vapor canister and atmospheric air through the pump;

a manifold, wherein the single CVV solenoid and the single CVV check valve solenoid are disposed in the manifold; and a pressure sensor located outside of the leak check module to perform a leak check in the fuel system;

wherein all fluid flowing between the second port of the pump and the fuel vapor canister flows through the second flow path and the single CVV check valve solenoid; and wherein the leak check module does not include a reference orifice.

9. The vehicle fuel system of claim 8, wherein the pump is reversible for establishing a vacuum or a pressure in the fuel system.

10. The vehicle fuel system of claim 8 further comprising first and second filters coupled to the first and second ports of the pump, respectively.

11. The vehicle fuel system of claim 8 further comprising single-piece manifold.

12. The vehicle fuel system of claim 11, wherein the manifold includes a canister port coupled to the fuel vapor canister and wherein the leak check module further comprises a pump port coupled to the manifold and coupled the pump, and an ATM port coupled to the manifold and to the atmospheric air.

13. The vehicle fuel system of claim 11 further comprising a flow path extending through a plenum wall beneath the CVV solenoid and through a central opening in the manifold between the CVV solenoid and CVV check valve solenoid.

14. The leak check module of claim 11, wherein the manifold includes a canister port coupling to the fuel vapor canister, a pump inlet opening coupled to the second port of the pump and a purge/refuel opening coupled to atmospheric air.

15. The vehicle fuel system according to claim 14, wherein the vehicle fuel system is configured to detect a leak in the fuel system using the pressure sensor outside of the leak check module while the CVV solenoid and the CVV check valve solenoid are both closed and the pump is off.

* * * * *